US008418624B2

(12) United States Patent
McGarraugh et al.

(10) Patent No.: US 8,418,624 B2
(45) Date of Patent: Apr. 16, 2013

(54) PROJECTILE DEVICE AND METHOD FOR TARGETED VEHICLE TRACKING

(76) Inventors: Jason Thomas McGarraugh, Nashville, TN (US); Barron Christopher Miller, Port St. Lucie, FL (US)

( * ) Notice: Subject to any disclaimer, the term of this patent is extended or adjusted under 35 U.S.C. 154(b) by 0 days.

(21) Appl. No.: 12/705,522

(22) Filed: Feb. 12, 2010

(65) Prior Publication Data

US 2010/0300320 A1 Dec. 2, 2010

Related U.S. Application Data

(60) Provisional application No. 61/152,479, filed on Feb. 13, 2009.

(51) Int. Cl.
*F42B 6/00* (2006.01)
*F42B 30/00* (2006.01)
*F42B 12/00* (2006.01)

(52) U.S. Cl.
USPC ..... 102/517; 102/519; 102/501; 102/499; 102/500; 102/439; 89/1.1

(58) Field of Classification Search ..... 102/501, 102/502, 517, 519, 499, 500; 89/1.11, 1.1
See application file for complete search history.

(56) References Cited

U.S. PATENT DOCUMENTS

| | | | | |
|---|---|---|---|---|
| 6,246,323 | B1 * | 6/2001 | Fischbach | 340/539.13 |
| 6,409,617 | B1 * | 6/2002 | Armold | 473/578 |
| 6,650,283 | B2 * | 11/2003 | Brydges et al. | 342/357.36 |
| 6,978,717 | B1 * | 12/2005 | Hambric | 102/473 |
| 7,207,274 | B1 * | 4/2007 | Plew et al. | 102/501 |
| 7,246,613 | B1 * | 7/2007 | Mohar | 124/57 |
| 7,275,889 | B1 * | 10/2007 | McGill | 404/6 |
| 7,412,321 | B2 * | 8/2008 | de Sylva | 701/101 |
| 7,453,356 | B2 * | 11/2008 | Bedenko | 340/539.13 |
| 7,895,788 | B1 * | 3/2011 | Cilia et al. | 42/106 |
| 7,990,265 | B2 * | 8/2011 | Fischbach et al. | 340/539.13 |

* cited by examiner

*Primary Examiner* — James Bergin
(74) *Attorney, Agent, or Firm* — Paul Royal; The Patent Guild

(57) ABSTRACT

An invention in which a projectile device is deployed from a compressed air firing system that, upon impact of the projectile device into a target, the projectile device embeds itself in the intended target's outer surface or material. In one application, a GPS receiver and transmitter provided within the projectile device relays position data to a receiving apparatus that is monitored by a stationary or mobile conveyance. In another application, the projectile device, may include remotely operable explosives which are preferably triggered once the target is an area where the explosives can be detonated with minimal collateral damage.

17 Claims, 9 Drawing Sheets

PROJECTILE DEVICE AND METHOD FOR TARGETED VEHICLE TRACKING

This Application relates to Provisional Application 61/152,479 Filed 13 Feb. 2009

FIELD OF INVENTION

The present invention relates to projectile device for deploying and impaling into a target.

BACKGROUND OF INVENTION

There is a world wide upsurge in episodes of criminal activity regarding the operation of motorized vehicles, and or mobile mechanical conveyances. Citizens placed in a position of confrontation or under rule of authority for insignificant and/or malicious infractions or crimes deviate from authorized direction by such authorities to cease operation of said conveyances. When they fail to stop, the level of violation and resistance committed is significantly raised.

Under a civilian crisis, as in a traffic stop where the violator refuses to cease operation of a vehicle and continues on a course simply away from the pursuing agent of authority, the propensity for intense biological stress upon the operators has been shown to limit logical decision making ability, therefore decreasing concern for self and others. The operator fleeing from authority may take drastic risks to escape detainment, sometimes causing minor to extravagant property destruction, as well as minor to serious injuries, or often taking of a human life. The media and news institutions, as well as federal, state, and local law enforcement agencies have termed these as police chases, or high-speed pursuits.

There is a paradigm shift in the law enforcement industry leading toward progressive policy changes in the reduction of the types of crimes committed that permit officers, deputies, troopers, or agents to pursue the suspect in flight. This paradigm shift is a result of the growing public and courtroom disdain of pursuits that kill or maim innocent people. As a direct result of years of policy modifications by departments and agencies all over the world, the general knowledge of such change has spread, and the dilemma of whether to chase or not is debated.

There are many devices that attempt to help law enforcement agencies avoid, prevent, and end vehicle pursuits. One of the very first such devices is what are called stop sticks. Stop sticks are a tire deflation device (TDD) that can be deployed several different ways. One way is to have a person near the roadway in front of the vehicle being pursued, and as the vehicle approaches, the person throws the TDD into the roadway directly in the vehicle's path in hope that the tires run over the deflation spikes. The obvious challenges with this is getting a person positioned ahead of the pursued vehicle, having the person throw the device in the roadway (which the vehicle can steer around it), retrieving the device from the roadway so that other non intended vehicles don't run over it, the danger of the person deploying the device being struck by the pursued or chase vehicle(s), and the possibility of the chase vehicle after having one or more of its tires deflated losing control and causing a crash.

Another way as described in U.S. Pat. No. 6,758,628 by Curry, Jr. is to have the stop sticks mechanically deployed by another pursuit vehicle, so as to avoid a person having to manually deploy the tire deflation device from the side of the road, exposing themselves to danger. However, this still does not solve the challenge of stopping the pursuit as the suspect vehicle can continue on its course of action, now possibly more uncontrollable than before. In addition, technological advances in tire manufacturing have made "run-flat-type" tires available for most vehicles, leaving a tire deflation device unpractical in some circumstances.

Another device designed to help eliminate vehicle pursuits is that of an electronic component fired to the suspect vehicle, with the intention of getting it to stick. A gun-type device is placed on the front of a law enforcement vehicle loaded with a device that is fired and designed to apply itself to the vehicle and track its location using GPS sensors from within, and transmitting such data to a receiving party. This technology aides law enforcement in the dilemma of whether or not to pursue, as they may fire the projectile, turn the police vehicle around, and let the suspect vehicle go. The suspect within the pursued vehicle will assume it has avoided capture from law enforcement authorities and presumably will resume normal motor vehicle operation that is less likely to cause a crash. The law enforcement agency tracks the suspect vehicle through use of the devices GPS transmitter located on the back of the vehicle, and plans where, when, and how the law enforcement agency will seize the vehicle in a safe place and take custody of the occupant(s). One such invention is U.S. Pat. No. 7,207,274 by Plew et al. that provides a method and system of firing a projectile comprised of a sticky medium containing a sensor within. They describe that a two-part dielectric gel polymer encased in the tip of the projectile will stick to a target when fired from a weapon, and subsequently transmit many different possibilities of data, depending on its mission and predetermined encased sensor, one being GPS, to a remote receiving apparatus. One of the pitfalls with a sticky substance used at a contact point is that it may not adhere to the targets surface when fired at a high velocity from a vehicle traveling at a very high rate of speed, and that the device houses a heavy payload of electronic equipment making adhesion even more difficult.

SUMMARY AND OBJECTS OF THE INVENTION

The projectile device is generally a pointed, barbed, cylindrical-shaped steel and aluminum projectile device housing a GPS receiving sensor, a cellular transmission device, and other support electronic devices used to track a vehicle or other conveyance. The data transmitted by the projectile device is relayed to a tracking agency allowing for a planned, and safer tactical capture strategy. Additionally, if munitions or disruptive technology (such as electromagnetic pulse equipment) are carried by the projectile device, armed services and security personnel can use the projectile device to remotely eliminate a target that has been identified within a heavily populated area by tracking the target and waiting until the target is in a location where it is safe to remotely trigger the munitions or other disruptive technology.

The present embodiment is of a method and system, for deploying a projectile housing GPS and other related electronic support sensors, from a compressed air system, either mounted from an aimable cannon on a vehicle or from a handheld weapon like device, and impaling the intended targets surface with the retention cross of the fired projectile, and tracking its location with supporting electronic apparatuses. The tip of this projectile has a retention cross that, while impacting the target, decelerates the penetration shaft containing a blank charge, while the outer housing containing a firing pin continues forward, impacting and thus firing the charge, explosively forcing the penetration shaft forward towards the impact point on the targets surface, where the pointed tip penetrates the surface, makes a hole and the barbs of the retention cross catch the lip of the now serrated material around the diameter of the hole, and locks it into place, making removal extremely difficult.

In a version designed for GPS tracking and threat elimination, the GPS and other related electronic support sensors and equipment would be complimented with remote activated explosives. Both mediums are intended to track using GPS apparatuses, one for use in law enforcement during high speed pursuits or for intelligence collection, the other with explosives for use with the armed services as a threat elimination device in an area deemed undesirable for the use of explosives, and must wait for the explosives to be detonated.

It is an object of this embodiment of the invention to provide a method for attaching a projectile fired from a high powered compressed air cannon at a suspect vehicle, and attaching it with the idea that removal of such projectile is not easy. It is an object of this embodiment to be able to be used during a high speed police chase, with no reasonable limitation of measured speed on a legal roadway. It is an object of this embodiment to eliminate high speed police chases using said embodiment and included GPS tracking systems, and statistically eliminate the chance of causing a crash resulting in property damage, injury, and or death. It is an object of this embodiment, when projectile is loaded with said GPS tracking equipment, and remote activated explosives, to be utilized in an armed forces scenario, specifically in a densely populated area, where a target has been acquired, and the need for the threat to be eliminated, the projectile can be fired by desired cannon to the threat, and subsequently tracked as the vehicle or conveyance retreats away from such a populated area where detonation is less likely to cause collateral damage. It is an object of this embodiment for the invention to cause damage to the target being fired at, allowing for the unique non obvious method of attachment to work.

DRAWING REFERENCE NUMBERS

Figure 1:
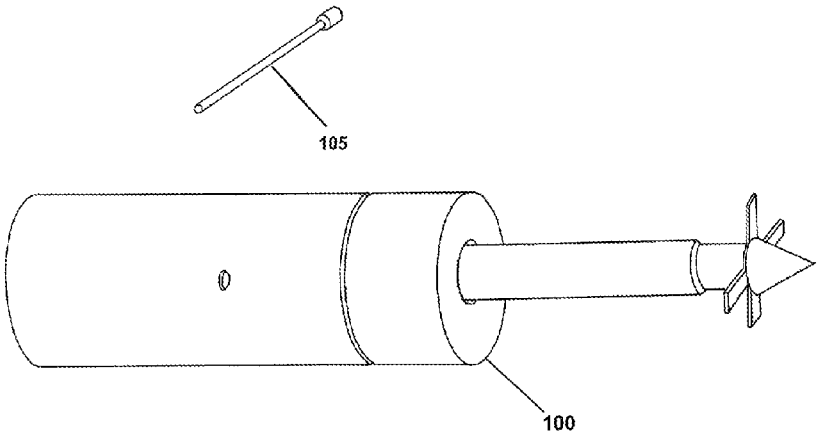
FIG. 1 presents an assembled projectile device with safety pin.

100 Projectile
102 Projectile Cut-Away view
104 Outer Housing
104A Pay load bay
104B Firing Pin Mounting Hole
104C Safety Hole
104D Interior of the Outer Housing
105 Safety Pin
108 Cap
108A Cap Threads
112 Penetration Shaft
112A Top of Penetration Shaft
112B Upper mid section of Penetration Shaft
112C Lower mid section of Penetration Shaft
112D O-ring Milled Groove
112E Lower section of Penetration Shaft
112F Charge Seat
112G Penetration Shafts' threaded bored tip hole
116 Firing Pin
118 O-ring, Large
119 O-ring, Small
120 Blank Cartridge
122 Retention Cross
124 Pointed Impact Tip
124A Pointed Impact Tip, Threaded Base
126 Target Surface Material
200 Vehicle Mounted Launch System
200A Laser Targeting Acquisition System
200B Vertical Aiming Apparatus System
300 Hand Held Launch System
400 Vehicle, Launch/Delivery
402 Vehicle, Target
500 Wired Electronic Medium Apparatus
500A Switch; Safety Covered, Device Power/Laser Targeting Acquisition
500B Switch; Spring, Controls Vertical Aiming Apparatus System
500C Switch; Firing Actuator
600 Blasting Cap and Primary Charge Apparatus
602 GPS Receiver/Cellular Transmission Device/Data Retrieval Antennae
604 RF Transponder/Remote Sensor/Data Transmitting and Receiving Device
606 Power Source (Battery)
608 Force Recognition Sensor
610 Payload Bay Door

DETAILED DESCRIPTION OF THE INVENTION

The present invention, as presented in FIGS. 1-12, is a projectile device generally comprising an outer containment housing, a penetration shaft extending from the outer containment housing, a tip attached to an end of the penetration shaft, a retention cross attached to the tip, within the outer containment housing is provided a charged round, a firing mechanism having a firing pin, a force recognition sensor, a power source, a data transmission and receiving device, a sensor recognition device and a data retrieval antennae and wherein the projectile device is formed as an aerodynamic cylindrical unit.

The projectile device 100 includes a pointed impact tip 124, a retention cross 122, a cap 108, a large O-ring 118, a small O-ring 119, a penetration shaft 112, a blank charge 120, a firing mechanism including a firing pin 116, and an outer housing 104. The safety pin 105 is of a cylindrical shape and size that will fit into the safety pin holes 104-C to block the firing pin from contacting the blank charge.

Some of the individual parts have areas on them that help further define its shape, or purpose, and are described as follows: pointed impact tip threaded base 124-A, cap threads 108-A, penetration shaft's threaded bored tip hole 112-G, top of the penetration shaft 112-A, upper mid section of the penetration shaft 112-B, lower mid section of the penetration shaft 112-C, milled groove 112-D, lower section of the penetration shaft 112-E, charge seat 112-F, interior of outer housing 104-D, safety pin holes 104-C, firing pin mounting hole 104-B, and payload bay 104-A.

Figure 5:
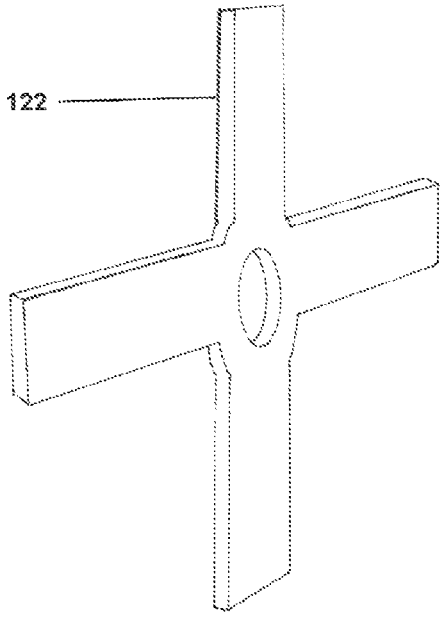
FIG. 5 presents the retention cross in a pre-deployment state.

As shown in FIG. 5, the retention cross 122 includes, but is not limited to a 4 bladed cross. There are several engineered forms, angles, thicknesses, shapes, lengths, or other undescribed variations or modifications to the retention cross 122, that will obviously mimic the method of this embodiment, and those skilled in the art will recognize that, and in the spirit of the invention the aforementioned claims relate to the scope and method of the functionality of the embodiment of the retention cross 122. The purpose of the retention cross 122, is to provide a method of embodiment to a target where removal of the projectile 100 from said target, is difficult.

Figure 12:
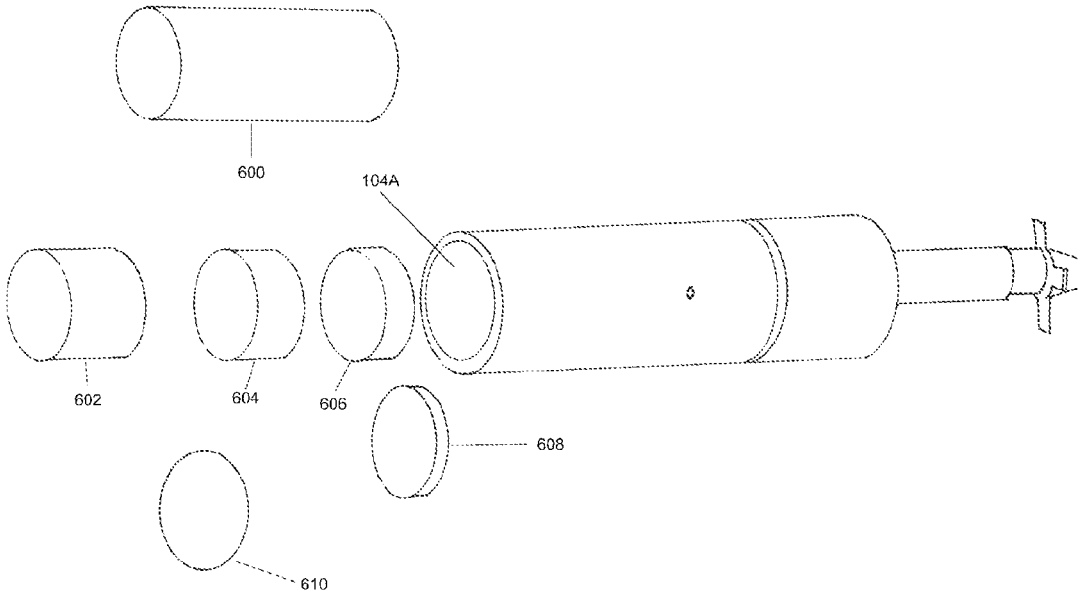
FIG. 12 presents the projectile device and components of payload bay.

As shown in FIG. 12, the payload bay 104-A contains a combined unit with a GPS receiver, Cellular Transmission Device/Data Retrieval Antennae 602, a combined unit with a RF Transponder/Remote Sensor/Data Transmitting and Receiving Device 604, a power source (battery) 606, a force recognition sensor 608, and covered by a payload bay door 610. The payload bay 104-A, in another application, contains a blasting cap with primary charge 600.

Figure 7:
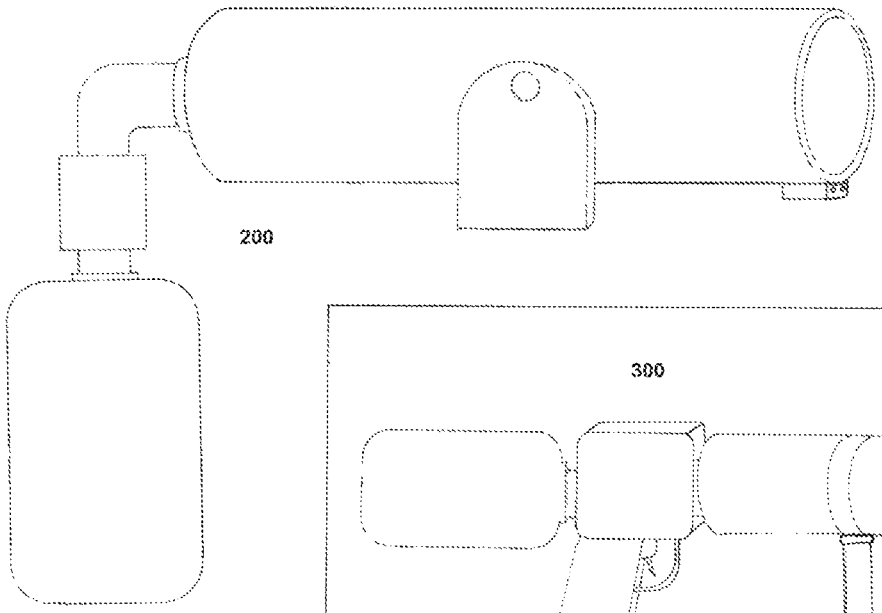
FIG. 7 presents the vehicle mounted launch system.

As shown in FIG. 7, is the vehicle mounted launch system 200, affixed laser targeting acquisition system 200-A, the Vertical Aiming Apparatus System 200B.

Figure 8:
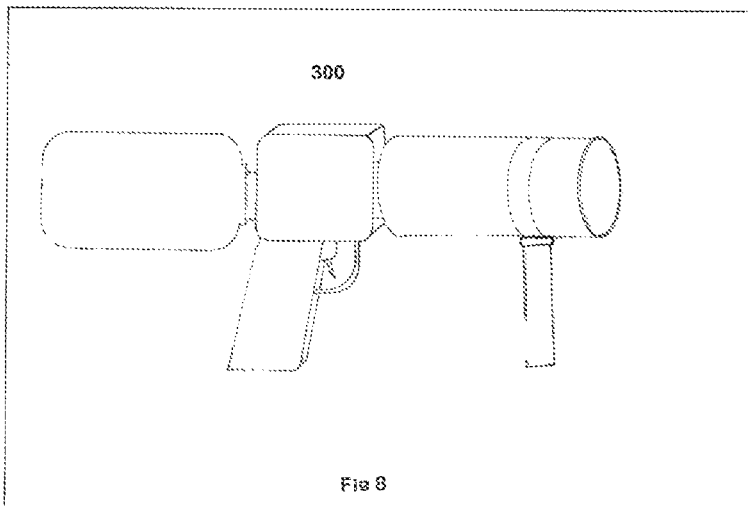
FIG. 8 presents the handheld launch system.

As shown in FIG. 8 is the Handheld Launch System 300.

Figure 9:
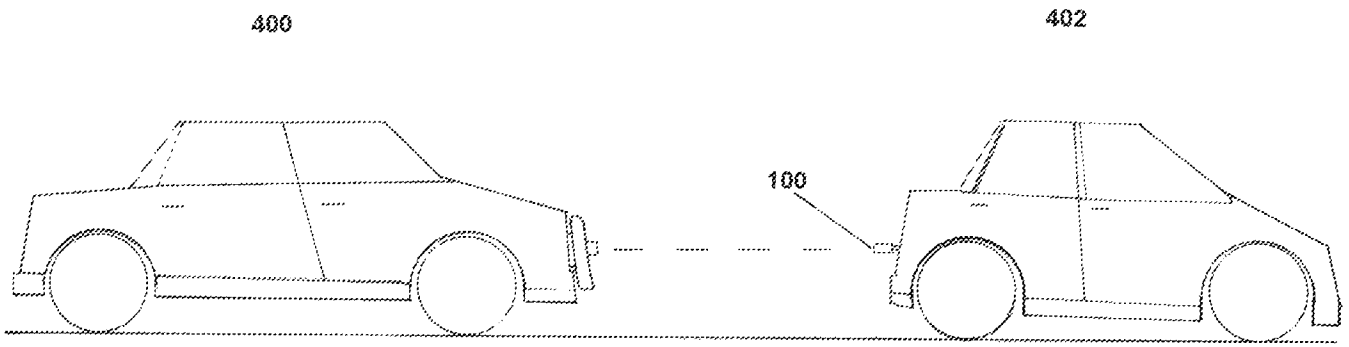
FIG. 9 presents a motor vehicle deploying a projectile device to a target.

As shown in FIG. 9, the vehicle 400 that is launching or delivering the projectile device 100, is shown behind the target vehicle 402.

Figure 10:
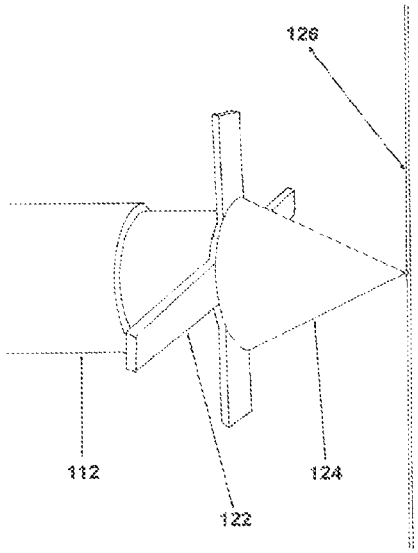
FIG. 10 presents the front of the projectile device making initial contact with the outer surface of a target.
Figure 11:
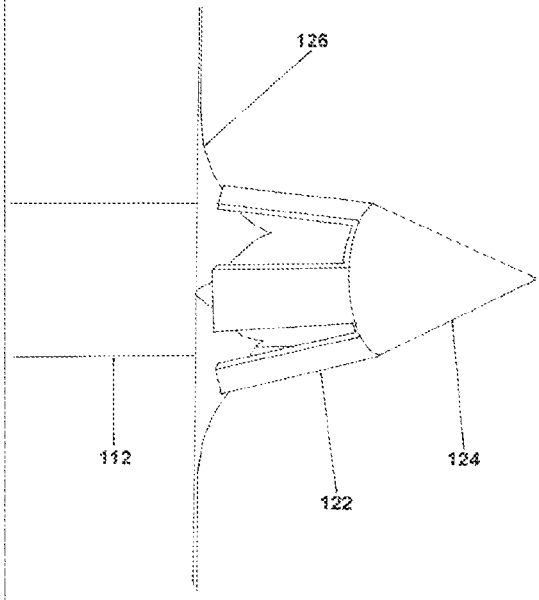
FIG. 11 presents the front of projectile device after penetration of into the target.

As shown in FIG. 10 and FIG. 11, the Targets Surface Material, is shown in a before and after image of the projectiles 100 impact.

Figure 13:
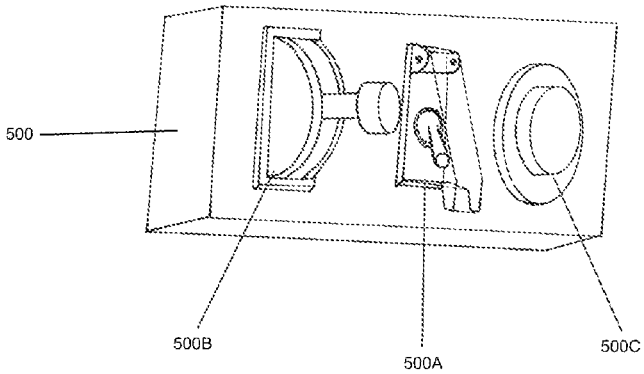
FIG. 13 presents the wired electronic medium

As shown in FIG. 13, the Wired Electronic Medium 500 controls the firing of the projectile 100 from the vehicle mounted launching system 200. The Wired Electronic Medium has a power switch 500-A, which is a safety covered switch that turns the power on to the projectile 100, the Vertical Aiming Apparatus 200-B, and the Laser Targeting Acquisition System 200-A. There is a Spring Switch 500-B, that controls the vertical movement of the vehicle mounted launching system 200 through the vertical aiming apparatus 200-B. There is a Firing Actuator Switch 500-C, that controls when the projectile 100 is fired from the vehicle mounted launching system 200.

General Assembly Process

Figure 2:
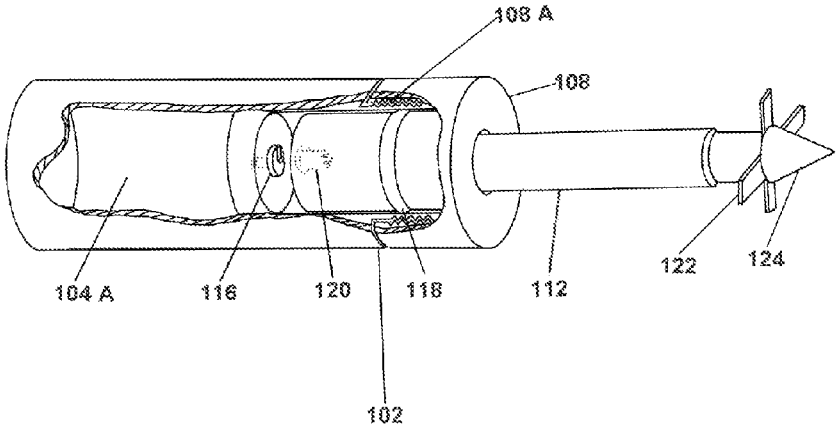
FIG. 2 presents a cut away view of the projectile device.
Figure 3:
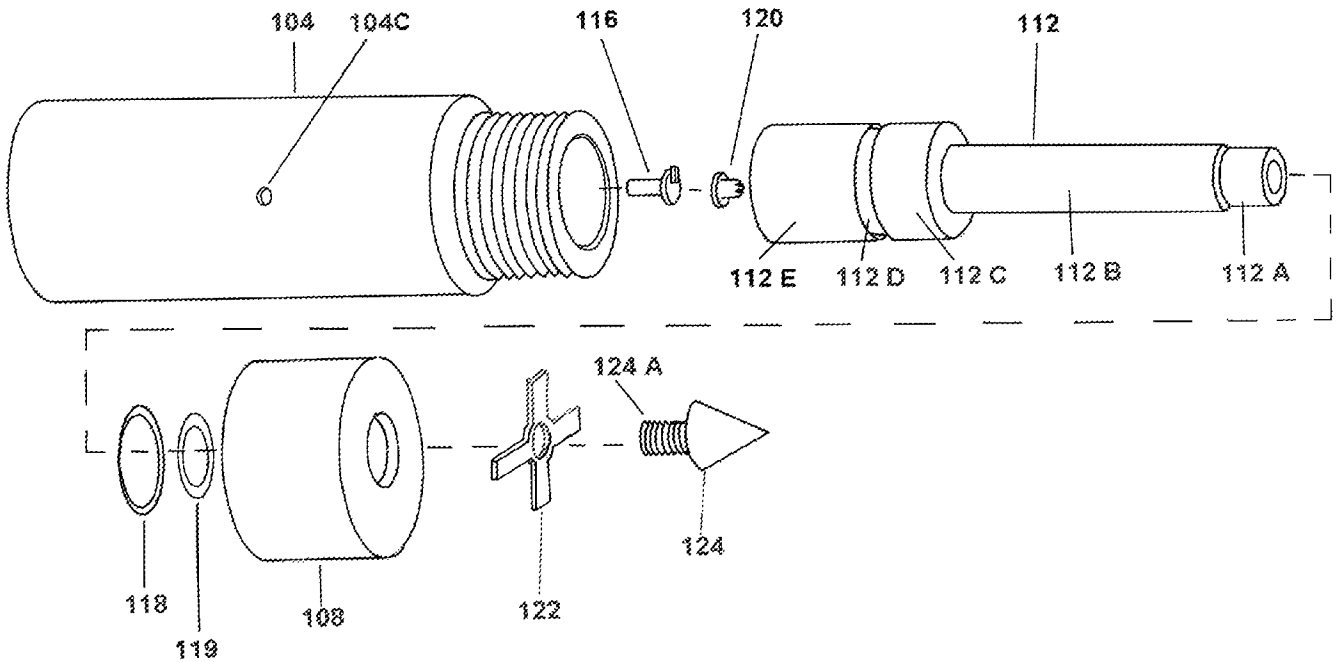
FIG. 3 presents an exploded view of the projectile device.

As shown in FIG. 1, the projectile 100 is of a cylindrical shape. As shown in FIG. 2, the projectile 100 is shown with the base of the outer housing 104, wider than the base of the penetration shaft 112. At the top of the penetration shaft 112, a retention cross 122, is secured to the penetration shaft 112, with the pointed impact tip 124. The diameter of the base of the penetration shaft 112 is wider than diameter of the upper portion of the penetration shaft 112 (to which the retention cross 122, and the pointed impact tips' base 124-A are attached), and is milled to slide down into the interior of the outer housing 104-D. In the mid section 112-C of the penetration shaft 112, there is a milled groove 112-D for placement of an O-ring 118, which assists in a snug fit into the outer housing 104, and the expansion of gases during the blank charge 120 firing process.

In the bottom of the outer housing 104, there is a firing pin 116, which is secured by means of adhesive bonding to the firing pin mounting hole 104-B.

The bottom of the penetration shaft 112, has a hole milled in the center called a charge seat 112-F, wherein, a blank charge 120 is placed, with the rim of the blank charge 120 wider than the diameter of the charge seat 112-F, so as not to let the rim of the blank charge 120 insert completely into the charge seat 112-F, thus leaving the rim of the blank charge 120, exposed, and nearly flush with the bottom of the penetration shaft 112. This design will allow for proper firing of the blank charge 120, which is a rim firing .25 caliber blank cartridge. In this described embodiment projectile 100, a rim fire cartridge is utilized to drive the penetration shaft 112 forward. Other embodiments may utilize a center fire cartridge, and may not be limited to any particular cartridge type or caliber. Different embodiments require different performance characteristics inherent to different cartridge types and sizes.

The penetration shaft 112, along with blank charge 120, O-ring 118, retention cross 122, and the pointed impact tip 124, are placed into the outer housing 104, with a small distance left between the firing pin 116, and the bottom of the blank charge 120. A small series of safety pin holes 104-C are bored into the mid section of the outer housing 104, and allow for a safety pin 105 to be inserted for safe handling of loaded projectile 100. The safety pin 105 is primarily used during maintenance, loading, unloading, training, or other unforeseeable operational manipulation while removed from the vehicle projectile launch system 200 (See FIG. 7), or a handheld projectile launch system 300 (See FIG. 8). The safety pin 105 may be provided in different shapes and configurations such as a bolt or other rigid member. The bored safety pin holes 104-C are also used for the escape of explosive gas and pressure when the penetration shaft 112 moves forward.

Figure 4:
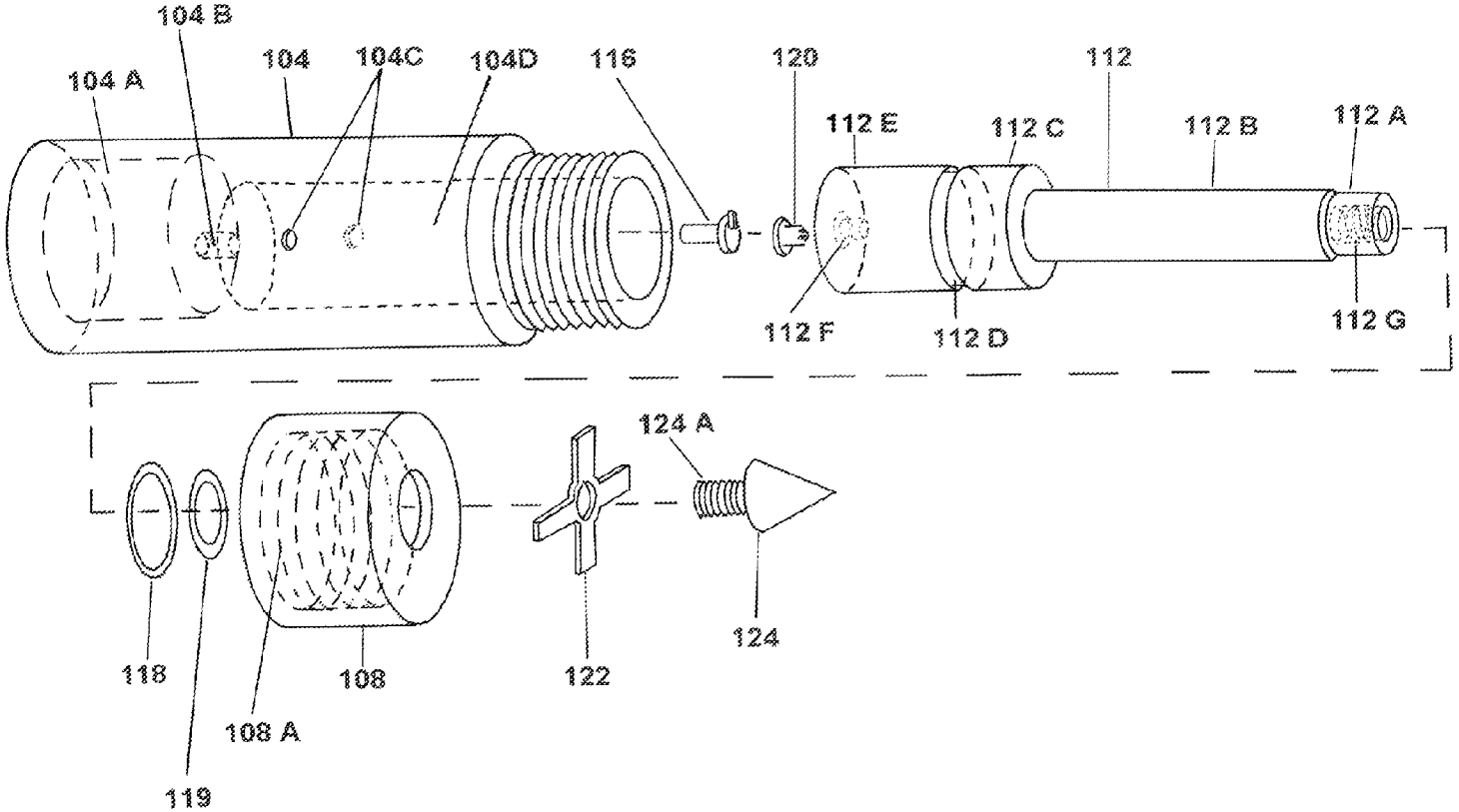
FIG. 4 presents a see thru view of the projectile device.

FIG. 4 shows the outer housing 104, the cap 108, and the penetration shaft 112, as the main body components of the projectile 100. When the penetration shaft 112, is inserted into the outer housing 104 with a blank charge 120, the fit is snug, and with the O-Ring 118 in place in the milled groove 122-D allows for a gas tight seal between the parts, which prevents gas leakage after firing of the blank charge 120. If the distance between the walls of the penetration shaft 112, and the walls of the outer housing 104 is too large, then during firing of the blank charge 120, the gases that are created would pass through the gap between said walls instead of forcing the penetration shaft 112 forward and into the target vehicle 402.

The cap 108, screws down onto the outer housing 104, after the penetration shaft 112 is placed into the outer housing 104. The penetration shaft 112, has a smaller diameter near the front 112-A, a larger diameter just behind it 112-B, an even larger diameter towards the mid and rear sections 112-C, and 112-E, and a groove 112-D separating sections 112-C, and 112-E. The groove 112-D is where the O-ring 118 is inserted to ensure a proper seal. The interior diameter of the hole at the top of the cap 108, has a slightly larger diameter than the penetration shafts' 112 section 112-B. Since the diameter of the penetration shafts 112 section 112-C, and section 112-E, is larger than the hole at the top of the cap 108, the penetration shaft 112 will not pass completely through the hole in the cap 108. The smaller diameter of the penetration shafts 112 section 112-A, allows for the retention cross 122, under stress of penetration to a targets outer material, to bend backwards towards the penetration shaft 112 section 112-A.

Referring to FIG. 4, the assembly process of the embodiment projectile 100 is done in the following order: firing pin 116 is attached to the firing pin mounting hole 104-B at the center of the base inside of the outer housing 104; a blank charge 120 is placed into the bored hole called the charge seat 112-F at the center of the bottom of the penetration shaft 112; an O-ring 118 is placed into the groove section 112-D of the penetration shaft 112; the penetration shaft 112 is then placed into the outer housing 104; another O-ring 119 is placed around the base of the penetration shaft 112 section 112-B; the cap 108 is then placed onto the threads of the outer housing 104, and the cap threads 108-A are tightened down; the retention cross 122 is then placed on top of the penetration shaft 112 section 112-A; the hole in the center of the retention cross 122, and the hole in the center of the penetration shafts 112 section 112-A, are of the same diameter, and are lined up. In the tip of the penetration shaft 112 section 112-A, there is a threaded bored tip hole 112-G. The threaded tip base 124-A of the pointed impact tip 124, then slides down into the matched up holes of the center of the retention cross 122, and the tip of the penetration shafts 112 section 112-A, and screws in to the tip hole 112-G. The means of attachment of the pointed impact tip 124, and tip base 124-A to the penetration shaft 112, can be done in a multitude of ways including, but not limited to: gluing, chemical weld, mechanical pinning, or threading. As shown in FIG. 4, the attachment of the pointed impact tip 124, and the tip base 124-A, is secured to the penetration shaft 112 section 112-A, by way of threading into the threaded tip hole 112-G. In another means of attachment of the pointed impact tip 124 as described above, the penetration shafts 112 section 112-A may not have a threaded tip hole 112-G, but a smooth tip hole 112-G.

Referring to FIG. 4, the outer housing 104 has an area behind the location where the firing pin mounting hole 104-B is located. Access to this area will be made through a door on the outer housing 104 to be designed specifically based on the exact measurements of the electronic equipment, and will change during further development and production, and such access door is not a claim being made on this embodiment. This area is referred to as the payload bay 104-A. In the payload bay 104-A, numerous types of electronic sensing and electronic support devises can be placed, including, but not limited to, radio frequency (RF) equipment, a force recognition sensor, power source, data transmission and GPS receiving devices, other sensor recognition devices, data retrieval antennae, and explosive munitions. The payload bay 104-A may utilize a small layer of force reduction type material just behind the firing pin mounting hole 104-B to help reduce the amount of G-force the payload experiences during deceleration. In the said projectile 100, the electronic devices loaded into the payload bay 104-A may be of many different types, models, and modified for particular missions. Such electronic devices must withstand high G-forces as equations for survivability are paramount in the success of the projectile 100 attaching to its' intended target, and delivering expected data, to the remote or stationary monitoring apparatus(s). The payload of choice is able to be loaded, unloaded, serviced, or repaired through the access door which is to be added during production. The projectile 100 will experience severe G-forces when it is fired from either a compressed air, or round fired system, and said projectile 100 impacts its intended target.

For illustrative purposes only, describing the operation, the target in the detailed description, and shown in FIG. 9, is that of a vehicle, however it is not limited to such conveyance, as the projectile 100 may be utilized on numerous other unstated targets.

Referring to FIG. 7, once the projectile 100 has been assembled, it is placed into the barrel of the vehicle mounted launch system 200. The vehicle mounted launch system 200 is mounted to a pursuit vehicle 400 (See FIG. 9), and is a mechanically aimable device by use of a wired, or wireless remote control from within or outside of pursuit vehicle 400.

Referring to FIG. 8, once the projectile 100 has been assembled, it is placed into the barrel of the handheld launch system 300. The handheld launch system 300 is carried by a person, and can be shoulder or hip fired, aimed by the operator themselves, and fired using a triggering mechanism controlled by a biomechanical digit.

The most appropriate launch system, either vehicle mounted launch system 200, or the handheld launch system 300, is selected by the operator as it relates to the mission at hand.

Use and Operation

Referring to FIG. 9, an example of a projectile 100 is fired from a pursuit vehicle 400, utilizing a vehicle projectile launch system 200, and impacting the target vehicle 402. In this illustration, the projectile 100 impales the rear of the target vehicle 402, and the penetration shaft 112, pointed impact tip 124, and retention cross 122, enter the outer layer of the target vehicle 402. The illustration demonstrates one example, but not limited to, the surface area of the target which the said projectile 100 can be fired at, the type of pursuit vehicle 400 the projectile can be fired from, and the location of the vehicle projectile launching system 200.

Figure 6:
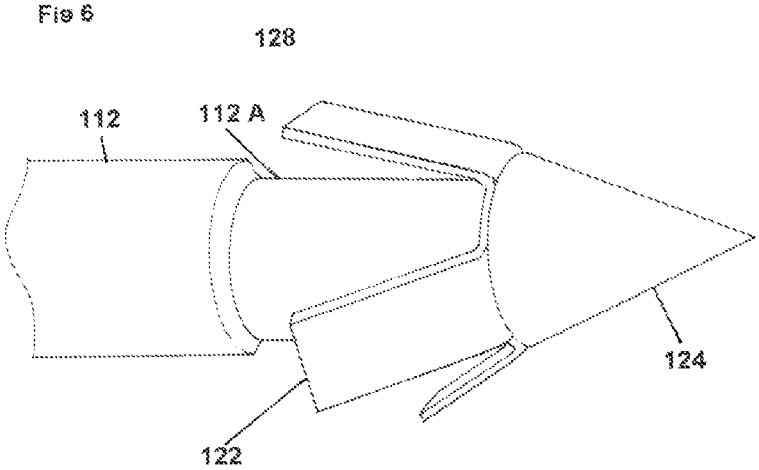
FIG. 6 presents the front of the projectile device in a post-deployment state.

Referring to FIG. 6, the depicted drawing is that of the front of the projectile 100, the pointed impact tip 124, the front of the penetration shaft 112 section 112-A, and partially 112-B, and the retention cross 122. The image is referred to as the front of the projectile with the retention cross in retaining form 128. The recessed diameter of the penetration shafts 112 section 112-A is visible, as it will allow for the retention cross 122, while penetrating the surface of the target, to fold rearward similar as depicted in the drawing, to aide in the reduction of overall diameter of the projectiles 100 diameter at the point of impact, thus allowing for penetration of thick surfaces of a target feasible.

Referring to FIG. 10, the depicted drawing is that of a perspective view of the front of the projectile 100 in flight, at the point where impact to the targets outer surface 126 is occurring. The retention cross 122 is still in its un-deployed state.

Immediately after the projectile 100 makes contact with its' intended target, the penetration shaft 112 is depressed slightly into the outer, housing 104. This depression causes the blank charge 120, that is seated into the charge seat 112-F, to forcefully make contact with the firing pin 116. Upon contact, the blank charge 120 will fire. The explosive gasses created by the firing of the blank charge 120, force the penetration shaft 112 forward, towards the target. This explosive force helps to drive the pointed impact tip 124, and retention cross 122, deeper into the surface of the target. The penetration shaft 112 stops its forward movement when the lower mid section 112-C makes contact with the cap 108.

The intention for the use of the blank charge 120 to create a large penetration force, is to ultimately reduce the speed at which the projectile 100 has to be fired from its launch system. Thus allowing for deployment of the projectile 100 to be done so with greater ease than with the use of gun power type firing systems such as grenade launchers, or shotgun shells.

Referring to FIG. 11, the depicted drawing is that of a perspective view of the front of the projectile 100, after impact and penetration has been made to a targets surface 126, where the material of the target has been broken and forced inward by the pointed impact tip, serrating the material around the hole. The retention cross 122, during penetration, folds rearward, and subsequently after penetration, springs open slightly, catching the serrated material of the hole in the targets surface 126. After the retention cross 122 catches the material of the target surface 126, it allows for the back half of the projectile 100, to remain outside of the target, making optimum use of a clear view of the sky, thus ensuring the GPS, or other receiving and transmitting sensors, have an uninterrupted medium by which to transfer data.

The means of deploying the projectile 100 from either the vehicle mounted launch system 200, or the handheld projectile launch system 300, includes, but not limited to, utilizing compressed air systems, explosive round fired system, or direct placement system. The detailed descriptions of the types of deployment systems are not included as the principles of the invention relate to its method of application, and tracking system. One type of a compressed air system of deployment utilizes fresh air, a sealed air tank, high pressure air valve, appropriate air fittings, and connects said equipment to a barrel which houses said projectile 100. A fresh air compressed air system can be filled and refilled easily by the operator from a type of portable or permanent air compressor, using fresh air, without regulation on how many times it can be refilled. Utilization of a pressure relief valve in the compressed air system ensures that over pressurization of the sealed air tank is unlikely, thus reducing the danger of an air tank eruption. Another type of compressed air system of deployment utilizes a sealed and pre manufactured compressed carbon dioxide (CO2) canister, canister puncture system, appropriate air fittings, and connects said equipment to a barrel which houses said projectile 100. A pre manufactured compressed CO2 canister is small, inexpensive, easily replaced after it is discharged, and will not leak air from its fittings connecting it to the other equipment. The CO2 canister can be pre manufactured to a certain pounds per square inch (PSI), therefore eliminating the need for a pressure relief valve.

An explosive round fired system utilizes an explosive burst from a blank cartridge charge placed in a firing sleeve, wherein; the base of the outer housing 104 fits into the sleeve, and the sleeve with the projectile 100 are placed in a barrel, and when detonated by the operator using a remote control apparatus, fires the projectile 100 out of the barrel to its target. There is no detailed description or diagram of this system as it is an example of a type of deployment system that may be utilized. This process is similar to that of a gun, or a gun that fires non lethal projectiles at a target. In this system, there is a barrel, a projectile 100, a blank charge firing sleeve, a blank charge (similar to illustration of 120), and no compressed air systems. The firing sleeve is a sleeve that the projectile 100 fits into, and located at the bottom of such sleeve is a small hole for a blank charge (similar to illustration of 120) to be inserted. A raised "floor" in the sleeve allows for the blank round (similar to illustration of 120) to sit flush with the bottom of the sleeve, and for the bottom of the embodiment projectile 100 to sit flush with the top of the "floor" near the bottom end of the interior of the sleeve, with the floor being as deep as the blank charge (similar to illustration of 120) is tall. Thus when the blank round (similar to illustration of 120) is fired in the sleeve by a firing pin device located in the rear of the barrel, the explosion of gases will escape forward into the sleeve forcing the projectile 100 out of the sleeve, out of the barrel, and towards its intended target.

In the direct placement system, a moveable mounted arm, extension, or telescoping pole is mounted to the front of a vehicle, and is the delivery system of the projectile 100. In this direct placement system, the projectile 100 is at the forward most end of the direct placement apparatus, and as the pursuit vehicle 400 closes the gap between it and the target vehicle 402, the tip of the projectile 100 is exposed from shelter and tapped onto a suitable surface on the target vehicle with an appropriate amount of force to activate the projectiles' 100 blank charge 120 thus activating the said attachment system. In the direct placement system, there is no compressed air system, or blank charge firing system, and the projectile 100 never flies through the air to attach itself to the target vehicle 402 or other undescribed mobile conveyance.

The invention presented through drawings, and description, has been done so with particular detail to this embodiment. Variations and modifications of the presented embodiment, that achieve the same results, might be made to those skilled in the art, and it is intended to be covered in the appended claims all such variations and modifications, and that the invention be limited only to the applicable rules of law. All patents cited above are incorporated by reference.

What is claimed is:

1. A projectile device comprising: an outer containment housing, a penetration shaft extending from the outer containment housing, a tip attached to an end of the penetration shaft, a retention cross attached to the tip, and within the outer containment housing is a charged round, a firing mechanism having a firing pin, a force recognition sensor, a power source, a data transmission and receiving device, a sensor recognition device and data retrieval antennae, and wherein the projectile device is formed as an aerodynamic cylindrical unit.

2. The projectile device of claim 1 wherein the aerodynamic shape of the projectile device conforms to a barrel of a launching tube for deployment of the projectile device.

3. The projectile device of claim 1 wherein after the projectile device is launched and impacts with a surface of a target vehicle, the impact slows down the forward movement of the penetration shaft while the outer containment housing continues moving forward thereby decreasing a configured gap between the firing pin and charged round, and upon contact between the firing pin and the charged round, the charged round detonates and creates a high-pressure thermal expansion of gases which rapidly expand within the outer containment housing thereby driving the penetration shaft forward such that the tip and retention cross embeds further into the targeted vehicle surface.

4. The projectile device of claim 3 wherein after the tip passes through the target vehicle surface, the tip expands at least partially back to the initial tip shape, thereby making it difficult to remove the tip from the target vehicle surface.

5. The projectile device of claim 4 wherein after the charged round detonates, the force recognition sensor electronically activates which activates the data transmission and receiving device.

6. The projectile device of claim 5, wherein after the data transmission and receiving device is activated, a power relay is activated to a data receiving device allowing reception of global positioning satellites pseudo-random digital code and subsequent trilateration, and to communicate said trilateration as latitude and longitude data (GPS) to said device through data retrieval antennae.

7. The projectile device of claim 6, wherein receives the GPS data, submits the projectiles location data, and a foreordained incomparable coded tag to a data transmission full duplex channeled cellular device, and consecutively transmits coded tag and location data to a pre-determined remote stationed server apparatus, which transmits it to a predetermined hardware apparatus.

8. The tracking system for the projectile device of claim 7, wherein the hardware apparatus stores and makes available location data from the deployed projectile to the user who has the access code to unlock said location data that match the foreordained incomparable coded tag, thus allowing only unique users to view the projectiles that have been programmed with a foreordained incomparable coded unit tag matched to said unique users.

9. The projectile device of claim 1, wherein the projectile device is launched from a launching tube mounted to a stable and mechanically aimable surface on a deployment vehicle, or handheld weapon type device, and utilizes a remotely activated, highly amplified and coherent radiation frequency laser that is mounted to a launching tube specifically used for target acquisition.

10. The projectile device of claim 9, wherein the launching tube device is an electro-pneumatically activated launch system utilizing high-pressure distribution components.

11. The projectile device of claim 1, wherein the tracking system of the projectile device is utilized by a law enforcement, intelligence collection, or a government agency, entity, or unit of the armed services to identify, target, and deploy the projectile in an effort to track target vehicle, vessel, aircraft, or other mobile mechanical means of transport or carriage, through GPS technology, all the while engaging in an electronic tracking form of pursuit, unbeknownst to the operator of the target vehicle or conveyance.

12. The projectile device of claim 1, wherein the projectile device is used to locate the target vehicle and track it to a location of an identifiably nominal risk to personnel and or property, and to aid in seizing the vehicle, and taking control of operator and/or passengers of the vehicle.

13. The projectile device of claim 1, further including a G-force reduction material, O-rings, and safety pin access.

14. The projectile device of claim 1, further including a radio frequency (RF) transponder, a sensor receiving device, a power source, and wherein the firing mechanism further includes a blasting cap or primary charge apparatus, and initiating propellant type of explosive.

15. The projectile device of claim 14, wherein the said projectile device is provided as a threat elimination system for use during a crisis that occurs in a densely civilian based population locale and requires military enforcement reaction.

16. The projectile device of claim 15, wherein the said projectile is deployed by a launching tube to impact a target conveyance, and the conveyance is tracked to a safer, less populated locale where a transmission is sent via a remote sensor transmitting apparatus to detonate an explosive contained within the projectile device, thus eliminating the target conveyance.

17. The projectile device of claim 1, wherein the projectile device is controlled by a wired electronic medium, housing momentary and spring switches controlling the mediums power, safety standby, laser targeting acquisition, vertical aiming apparatus of the launching tube, and fire actuator.

* * * * *